US011872437B2

(12) United States Patent
Gresham

(10) Patent No.: US 11,872,437 B2
(45) Date of Patent: Jan. 16, 2024

(54) ALTERNATE EXERCISE ADAPTER ATTACHMENT FOR EXERCISE MACHINES

(71) Applicant: Bradley Gresham, Chesapeake, VA (US)

(72) Inventor: Bradley Gresham, Chesapeake, VA (US)

(73) Assignee: Rowdaptor, LLC, Chesapeake, VA (US)

( * ) Notice: Subject to any disclaimer, the term of this patent is extended or adjusted under 35 U.S.C. 154(b) by 0 days.

(21) Appl. No.: 17/139,224

(22) Filed: Dec. 31, 2020

(65) Prior Publication Data

US 2021/0299510 A1 Sep. 30, 2021

Related U.S. Application Data

(60) Provisional application No. 62/955,868, filed on Dec. 31, 2019.

(51) Int. Cl.
*A63B 21/00* (2006.01)
*A63B 22/00* (2006.01)

(52) U.S. Cl.
CPC ..... *A63B 21/156* (2013.01); *A63B 22/0076* (2013.01); *A63B 2022/0079* (2013.01)

(58) Field of Classification Search
CPC ..... A63B 2022/0079; A63B 22/0076–0089; A63B 21/00047; A63B 21/15–156; A63B 21/16; A63B 22/0087–0089
See application file for complete search history.

(56) References Cited

U.S. PATENT DOCUMENTS

| | | | | |
|---|---|---|---|---|
| 2004/0043873 | A1* | 3/2004 | Wilkinson | A63B 21/00065 482/52 |
| 2016/0279464 | A1* | 9/2016 | Liu | A63B 21/4047 |
| 2018/0200563 | A1* | 7/2018 | Hansen | F16B 21/09 |
| 2018/0214734 | A1* | 8/2018 | Lammers | A63B 21/225 |
| 2020/0114195 | A1* | 4/2020 | Henniger | A63B 21/4043 |
| 2020/0155889 | A1* | 5/2020 | Leipheimer | A63B 21/00065 |
| 2021/0170221 | A1* | 6/2021 | Hsu | A63B 21/153 |
| 2022/0047909 | A1* | 2/2022 | Beecroft | A63B 21/156 |

* cited by examiner

*Primary Examiner* — Joshua Lee
*Assistant Examiner* — Catrina A Letterman
(74) *Attorney, Agent, or Firm* — Tanner IP, PLLC

(57) ABSTRACT

An alternate exercise adapter for exercise machines having an intended function is designed to be attached to an exercise machine in order to provide the option of performing alternative exercises beyond the intended function(s) of the exercise machine, thereby transforming the exercise machine (such as a rowing machine) into a multi-use, multi-purpose training device. The adapter may include a pulley mounted on a pivoting arm, affixed to mounting blocks for attaching the adapter to an exercise machine. By placing the exercise machine's drive chain or belt in the open-block pulley, the drive path may be altered, e.g. allowing the transfer of force in the vertical plane. This may allow a user to perform additional exercise movements (bicep curls, reverse bicep curls, shoulder front raises, high pulls, overhead presses, front squats, et. cetera), providing for alternate use of the exercise machine's resistance mechanisms.

17 Claims, 15 Drawing Sheets

122/124

ALTERNATE EXERCISE ADAPTER ATTACHMENT FOR EXERCISE MACHINES

This application claims priority to U.S. Provisional Patent Application No. 62/955,868, filed Dec. 31, 2019, and entitled "Alternate Exercise Adapter Attachment for Exercise," the entire contents of which are hereby incorporated by reference for all purposes.

BACKGROUND

The present subject matter relates to the field of exercise equipment, and more specifically, to alternative exercise adapter attachments for use with exercise equipment, such as rowing machines, that increase the capability of the equipment by transforming the equipment into a multi-use, multi-purpose training device capable of performing a wider variety of exercises.

Indoor rowing machines, and other rail-based exercise equipment, have enjoyed growing popularity worldwide. Many serious fitness enthusiasts and competitive athletes such as rowers use these machines to maintain physical fitness year-round. However, many such machines are purpose-built for specific exercises or motions. For example, while popular, the rowing machine is built to a single purpose and function, to exercise the rowing stroke, and as such, it provides little utility for the exercise of other movements or functions.

However, the inventor has found that, by providing adapter attachments such as those discussed herein, that facilitate alternative resistance motions, such as the vertical application of force to a rowing machine, the rowing machine or other exercise machine can then support the performance of other popular exercises, increasing its utility as a fitness device.

SUMMARY

This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter.

According to first aspects of the disclosure, an alternate exercise adapter attachment (for exercise machines having an intended function) is designed to be attached to an exercise machine in order to provide the option of performing alternative exercises beyond the intended function(s) of the exercise machine, thereby transforming the exercise machine (such as a rowing machine) into a multi-use, multi-purpose training device.

In embodiments, the adapter device may include an open-block pulley mounted on a pivoting pulley arm, affixed to mounting blocks for attaching the adapter device to an exercise machine. By placing the exercise machine's drive chain or belt in the open-block pulley, the drive path may be altered, e.g. allowing the transfer of force in the vertical plane. This may allow a user to perform additional exercise movements (bicep curls, reverse bicep curls, shoulder front raises, high pulls, overhead presses, front squats, et. cetera), providing for alternate use of the exercise machine's resistance mechanisms. Once installed, the adapter device in no way impedes normal function of the exercise machine as intended by the manufacturer. For example, a rowing machine may maintain its intended function as a rowing machine without interference from the adapter device, such as by removing the rowing machine's drive chain or belt from the pulley and allowing the adapter device to fold out of the normal path of the rowing drive chain or belt.

In embodiments, the open-block pulley design may allow a user to simply and immediately place or remove the drive chain or belt in the pulley, and a pivoting design of the pulley arm may allow it to rotate freely as needed for use, or lay substantially flat, out of the path of the drive chain when the exercise machine is being used as originally intended. As such, the pivoting open-pulley design facilitates rapid transition from normal machine use to alternate uses, allowing for the creation of highly variable interval training sessions across multiple muscle groups. As a measure of safety, a spring-actuated safety mechanism may be affixed to the device preventing inadvertent disengagement of the drive chain or belt from the pulley.

A separate standing platform and/or bracing strap may be affixed to or draped over the machine to provide bracing function which utilizes the user's body weight to pin the machine to the floor should the user be standing while performing specific resistance exercises. The standing platform and/or bracing strap can be used in ways that do not impede normal, intended function(s) of the exercise machine when attached, and can quickly be removed, e.g. by means of buckle(s) and/or hook and loop fastening devices.

The pivoting, open-pulley design of the adapter device provides particular advantages such as allowing for normal use of a rowing machine while installed, and also to facilitate rapid transitions to alternate exercises for high-intensity workouts.

According to further aspects of the disclosure, an adaptive system for use with an exercise machine may include a post having a proximal end and a distal end, a roller disposed at the distal end of the post, and an attachment mechanism configured to attach the proximal end of the post to the exercise machine.

In embodiments, the attachment mechanism may be configured to attach the proximal end of the post to a rail of the exercise machine or a preconfigured attachment point intended for another part of the exercise machine.

In embodiments, the post may include a track configured to accommodate at least one of a chain, cable, line, or strap of the exercise machine between an edge of the roller and an edge of the track.

In embodiments, the track may be accessible by a user to insert and remove the at least one of a chain, cable, line, or strap to or from the track, and/or the post may be configured to transition between a first position when the system is in use and a second position when the system is not in use.

In embodiments, the post may be configured such that (a) when the adaptive system is not in use, the at least one of a chain, cable, line, or strap of the exercise machine can operate according to the intended function(s) of the exercise machine without obstruction by the adaptive system, and (b) when the adaptive system is in use, the at least one of a chain, cable, line, or strap of the exercise machine operate through the adaptive system to provide another exercise function that is different than the intended function(s).

Embodiments may include a gate that is configured to selectively open and close the track to, for example, allow the user to insert the at least one of a chain, cable, line, or strap in the track and remove the at least one of a chain, cable, line, or strap from the track with the gate open, and/or retain the at least one of a chain, cable, line, or strap in the track with the gate closed.

In embodiments, the adaptive system may be configured to attach to a rowing machine.

In embodiments, the post may be configured to transition between a first position and a second position, in which the first position may substantially horizontally align the roller with a path of the at least one of a chain, cable, line, or strap, and allow the at least one of a chain, cable, line, or strap to be drawn upward by the user for resistance training.

In embodiments, the first position may substantially horizontally align the roller with a path of the at least one of a chain, cable, line, or strap, and the second position may remove the roller from horizontal alignment with the at least one of a chain, cable, line, or strap.

In embodiments, the post may be configured to transition between the first position and the second position via gravity and/or via user manipulation.

In embodiments, the post may be mechanically biased toward the second position, e.g. via an internal spring.

Embodiments may include a platform configured to allow the user to stand upon it while using the system. The platform may include an attachment mechanism configured to attach the platform to a rail of the exercise machine and/or the adaptive system, and to thereby resist upward movement of the rail during use of the adaptive system with the exercise machine.

In embodiments, the platform may have horizontal dimensions of approximately 24 inches by 16 inches. In embodiments, the platform may be foldable.

In embodiments, the attachment mechanism may include an adjustable strap.

Embodiments may include a strap configured to allow the user to stand upon it, and to attach to the rail of the exercise machine, while using the system, and to thereby resist upward movement of the rail during use of the adaptive system with the exercise machine.

In embodiments, the adaptive system may include an attachment mechanism configured to attach the proximal end of the post to the exercise machine. Such attachment mechanisms may include one or more of a first rail connector, a second rail connector, and an interconnector that is configured to attach the first rail connector to the second rail connector on opposite sides of the rail of the exercise machine. In embodiments, the interconnector may be configured to pass through a portion of the proximal end of the post.

In embodiments, the attachment mechanism may include a first connector that is configured to attach to a first preconfigured attachment point on an exercise machine, and an interconnector that is configured to attach the first connector to the proximal end of the post. In embodiments, the interconnector may be configured to allow the post to pivot with respect to the first connector.

According to further aspects of the disclosure, an adaptive system for use with an exercise machine may include a post including a proximal end, a distal end, a roller disposed at the distal end of the post, and a track configured to accommodate at least one of a chain, cable, line, or strap of the exercise machine between an edge of the roller and an edge of the track.

In embodiments, the track may be accessible by a user to insert and remove the at least one of a chain, cable, line, or strap of the exercise machine to or from the track.

Embodiments may include a gate configured to selectively open and close the track to allow the user to insert the at least one of a chain, cable, line, or strap in the track and remove the at least one of a chain, cable, line, or strap from the track with the gate open, and/or retain the at least one of a chain, cable, line, or strap in the track with the gate closed.

According to further aspects of the disclosure, an adaptive system for use with a rowing machine may include a post having a proximal end, a distal end, and a track configured to accommodate at least one of a chain, cable, line, or strap of the rowing machine. In embodiments, the track may be accessible by a user to insert and remove the at least one of a chain, cable, line, or strap to or from the track, and the post may be configured to transition between a first position when the system is in use and a second position when the system is not in use.

Other embodiments may include methods of manufacturing adaptive systems as described herein, and various methods of using such devices.

These and other aspects of the invention will now become apparent to those of ordinary skill in the art upon review of the following description of embodiments of the invention in conjunction with the accompanying drawings.

BRIEF DESCRIPTION OF THE DRAWINGS

So that the manner in which the above-recited features of embodiments can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
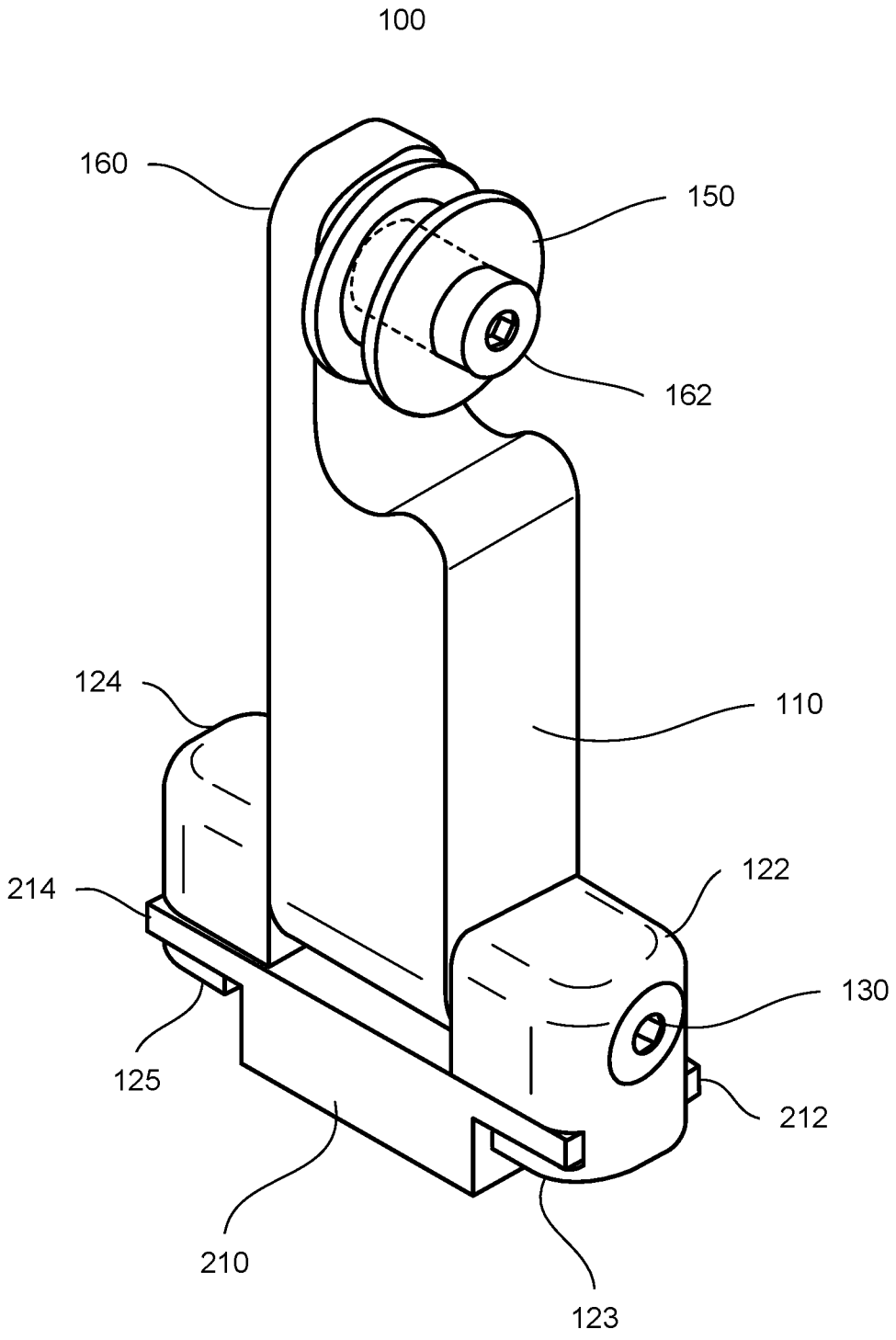
FIGS. 1-2 depict an exemplary adaptive system according to aspects of the disclosure.

It is to be expressly understood that the description and drawings are only for the purpose of illustrating certain embodiments of the invention and are an aid for understanding. They are not intended to be a definition of the limits of the invention.

DETAILED DESCRIPTION

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a connector" is a reference to one or more connectors and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Terms of degree may be used to describe various features of the disclosure, and may be interpreted as follows, unless otherwise specified. As used herein, the term "substantially" may be interpreted as greater than 75%, and the term "approximately" may be interpreted as ±10%.

As discussed herein, aspects of the disclosure may generally describe alternate exercise adapter attachments for exercise machines having an intended function(s), that add other exercise functions. In some examples, alternate exercise adaptive systems may include two distinct components, which may generally be referred to as a pulley arm assembly, and a standing platform/bracing strap.

In embodiments, exemplary pulley arm assemblies may include one or more mounting blocks, a pivoting pulley arm, and an open-design pulley (with or without a safety gate).

Figure 2:
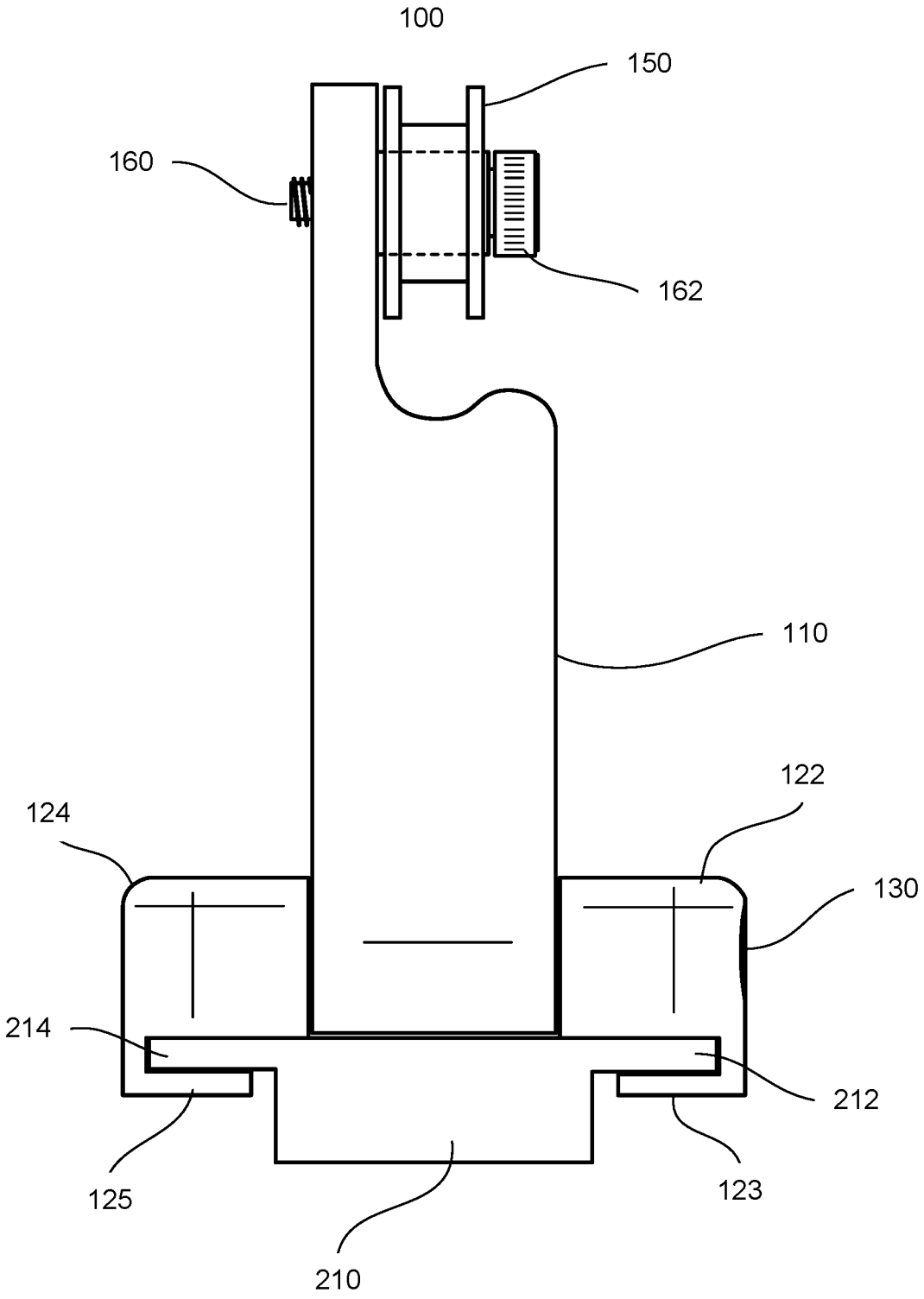

FIGS. 1-2 depict an exemplary adaptive pulley arm assembly 100 according to aspects of the disclosure. As shown in FIGS. 1 and 2, pulley arm assembly 100 may include a post 110, mounting blocks (shown as first rail grabber 122, and second rail grabber 124), interconnector 130, roller 150, roller support 160, and roller post/connector 162.

Figure 3:
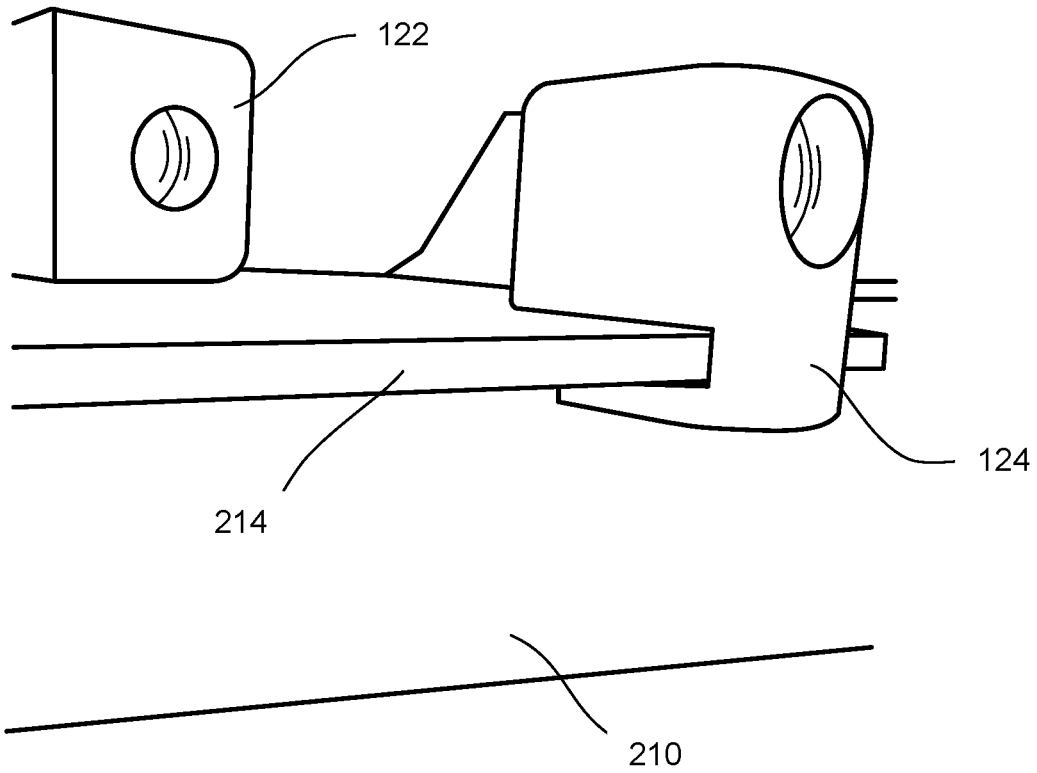
FIGS. 3-4 depict exemplary rail attachment mechanisms according to aspects of the disclosure.

The mounting blocks (first rail grabber 122 and second rail grabber 124) may be configured to affix the post 110 of the pulley arm assembly to a rail or track-based exercise machine, such as a rowing machine. For example, as shown in FIGS. 1 and 2, an exercise machine rail may include beam 210, with a first flange 212, and a second flange 214. Engagement elements 123, 125 of the first rail grabber 122 and second rail grabber 124 wrap at least partially around the first flange 212 and second flange 214 to secure the adapter assembly 100 to the exercise machine rail. This is shown in additional detail in FIG. 3, which shows the first rail grabber 122 and second rail grabber 124 engaged with flanges of beam 210.

Figure 4:
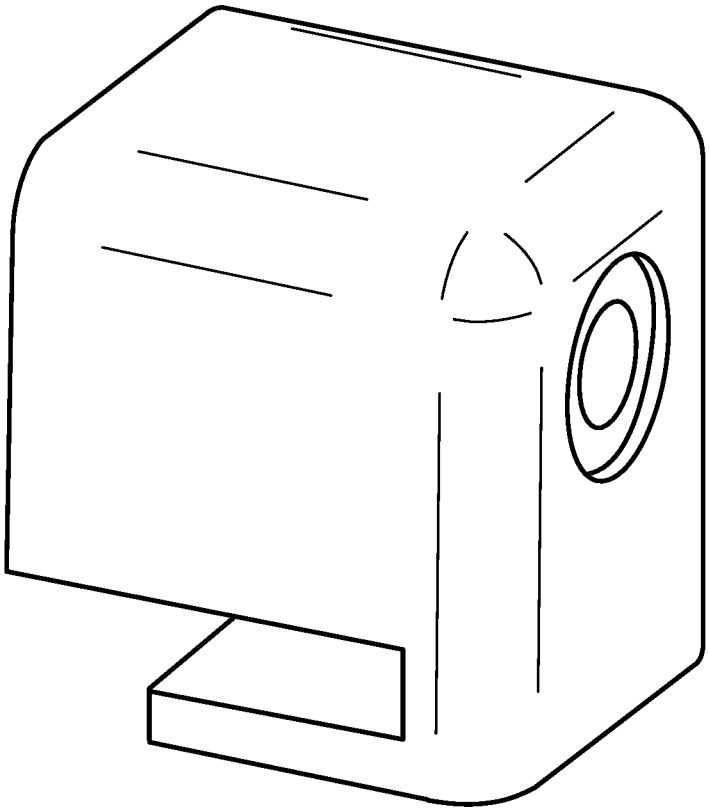
Figure 5:
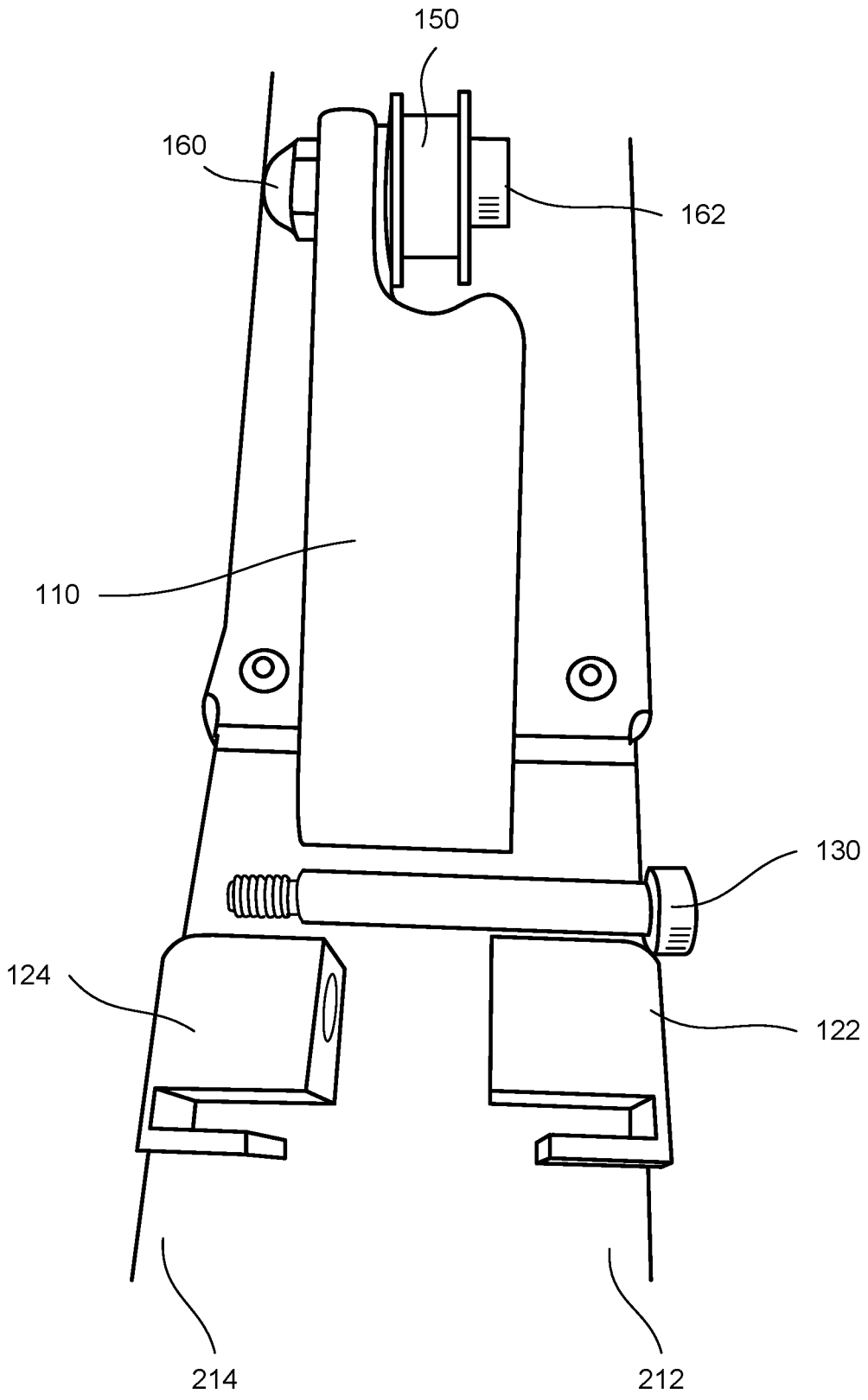
FIG. 5 depicts an exemplary disassembled adaptive system according to aspects of the disclosure.

As shown in FIG. 4, the first rail grabber 122 and second rail grabber 124 may have a similar construction, depending on the attachment means of the interconnector 130. In some examples, the first rail grabber 122 and second rail grabber 124 may have slightly different configurations, e.g. one may have a smooth bore for interconnector 130 to pass through and the other may have threads to receive the interconnector 130. An example of this configuration is shown in FIG. 5, including threads on the distal end of interconnector 130 that engage with cooperating threads (not shown) inside the bore of second rail grabber 124. Such configurations may allow, for example, the assembly 100 to be securely mounted to rails of different dimensions.

Figure 6:
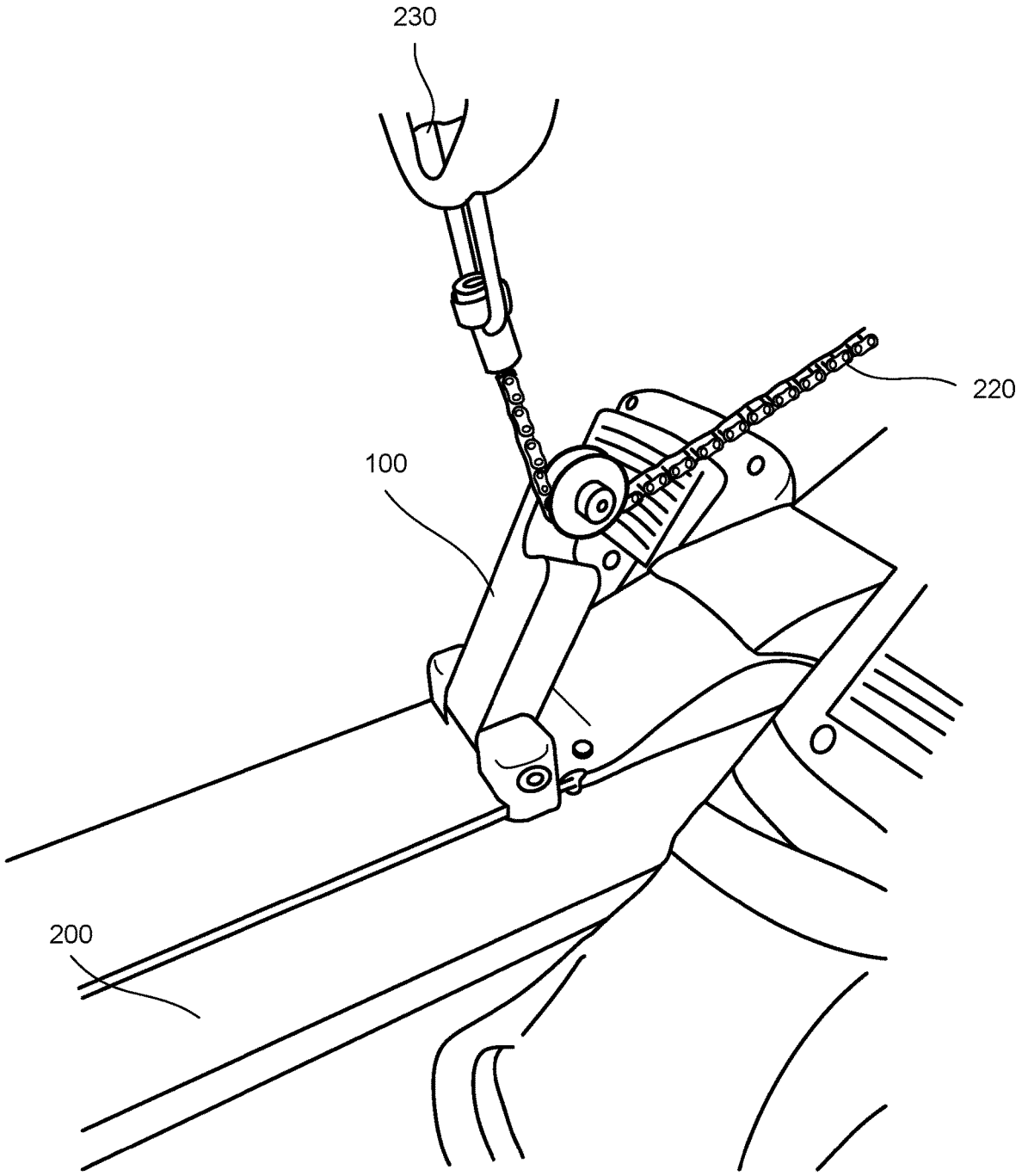
FIG. 6 depicts an exemplary adaptive system according to aspects of the disclosure in use on a rowing machine.

The post 110 may be positioned between first rail grabber 122 and second rail grabber 124, and connected in a pivoting arrangement via an interconnector 130 that goes through post 110, first rail grabber 122, and second rail grabber 124. In use, the pulley arm assembly 100 can be positioned such that a chain, cable, line, strap, or similar component (collectively referred to herein as "pulling components") of an exercise machine can be run partially around the roller 150. FIG. 6 shows an example of the pulley arm assembly 100 attached to a rowing machine track 200, with chain 220 wound through the pulley arm assembly 100 and extending to a rowing machine handle 230 (or other distal handle/component).

Accordingly, in this embodiment, the mounting block(s) and pulley arm assembly facilitate the post 110 pivoting along the transverse axis via a single through-axle mechanism. The pulley arm assembly 100 can easily be installed and removed, and requires no modification to the rowing machine. Thus, a user can alter the normal resistance direction of the chain 220, e.g. from horizontally to vertically (or partially vertically), allowing the rowing machine (or other exercise equipment) to perform additional functions, such as curls, lifts, etc.

Figure 7:
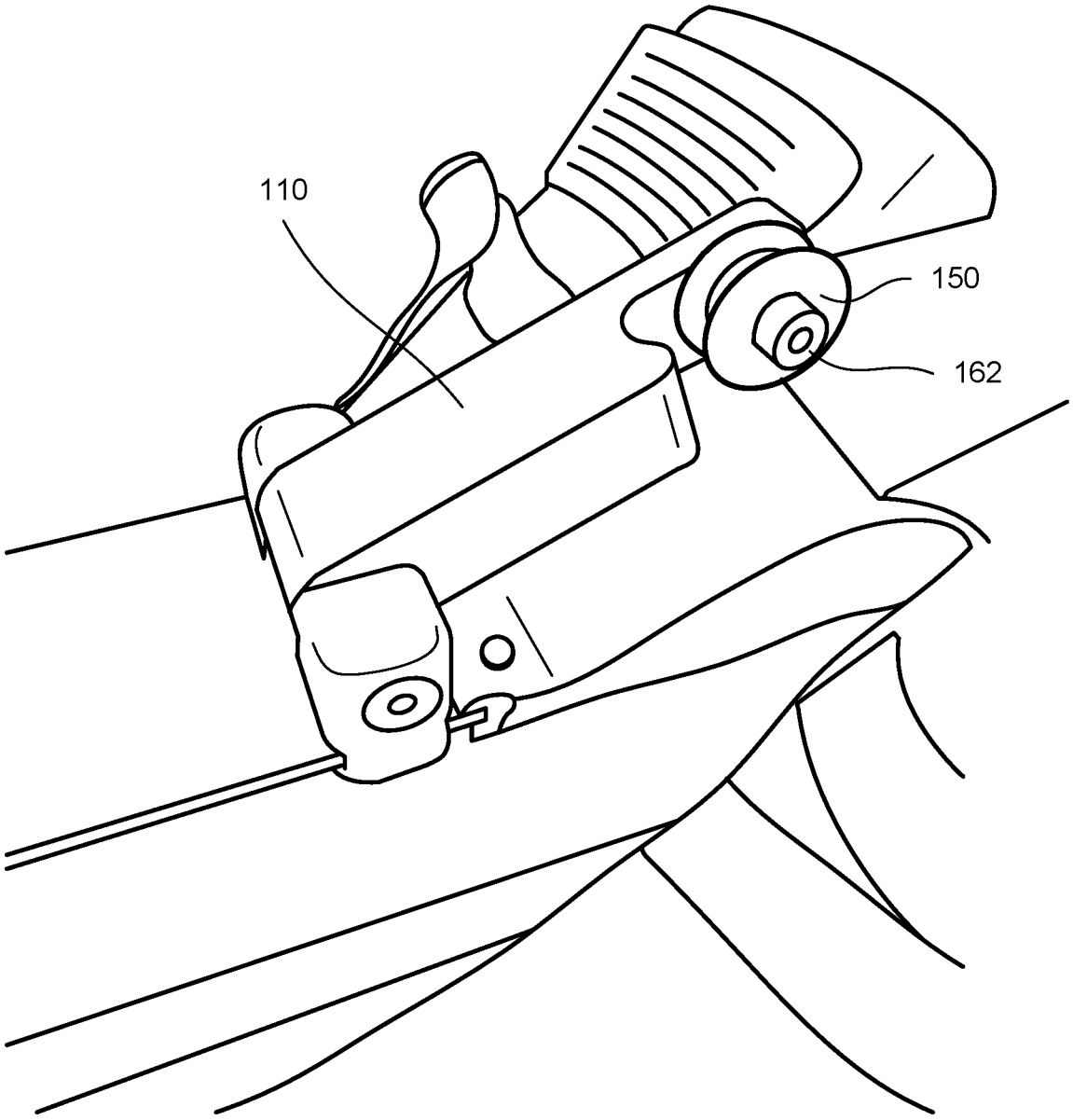
FIG. 7 depicts an exemplary adaptive system according to aspects of the disclosure, attached to a rowing machine rail, in a lowered position.

In some examples, the pulley arm assembly 100 can remain on the exercise machine when not in use without impeding the normal operation/function of the machine. For example, as shown in FIG. 7, the post 110 can be rotated by the user (or allowed to fall via gravity or an internal spring bias) to a position in which the roller 150 does not interfere with the horizontal draw of the chain or other pulling component.

Figure 8A:
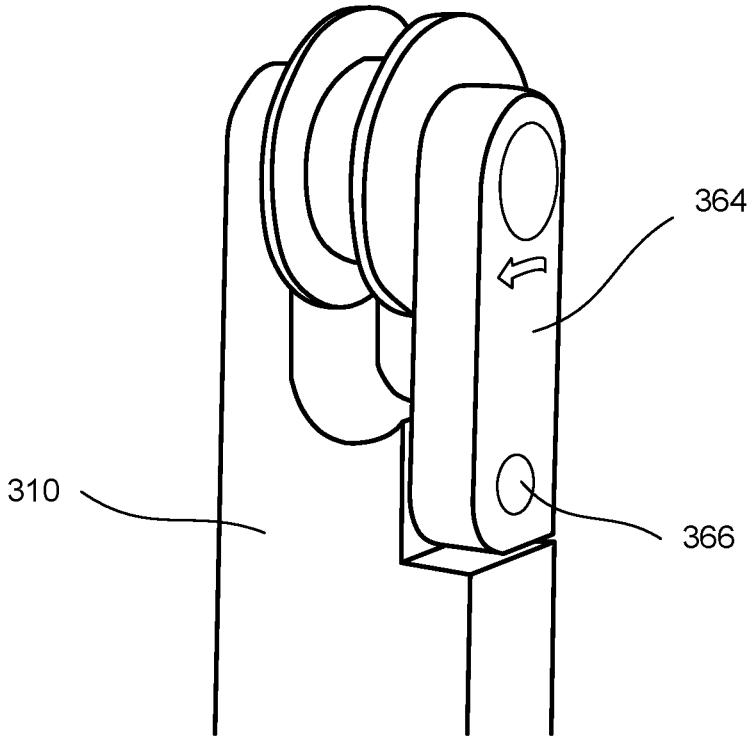
FIGS. 8A and 8B depict an exemplary gate mechanism according to aspects of the disclosure.
Figure 8B:
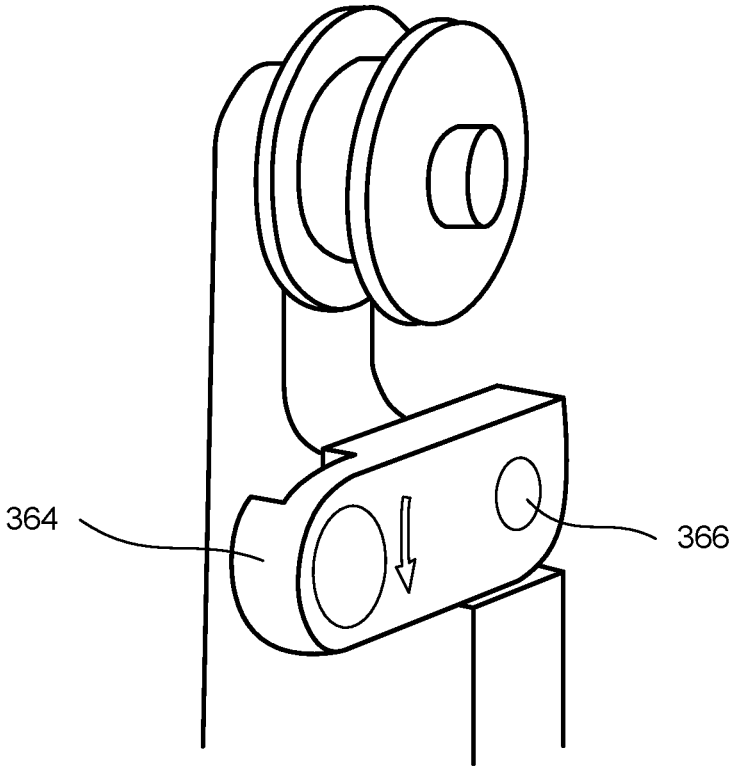

Turning to FIGS. 8A and 8B, a similar pulley arm assembly may be provided with means for temporarily securing the pulling component in a track formed by the roller 150 and cutout of post 110. In this example, a rotating gate 364 may be provided that opens and closes the track formed by the roller and cutout of the post. The rotating gate 364 may include a hinge 366 that allows it to transition between a closed position (as in FIG. 8A) and an open position (as in FIG. 8B). In some examples, the hinge 366 may include a spring that biases the gate 364 toward the closed position. A spring-actuated safety gate may be advantageous in that it allows for rapid insertion and removal of the pulling component, and prevents the pulling component from inadvertently disengaging from the track.

Figure 9A:
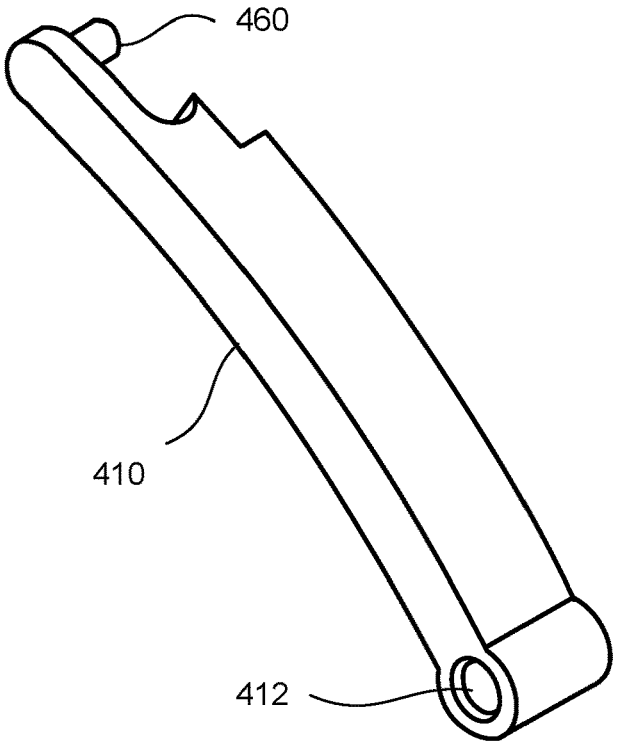
FIGS. 9A and 9B depict an alternative post and adaptive system according to aspects of the disclosure.
Figure 9B:
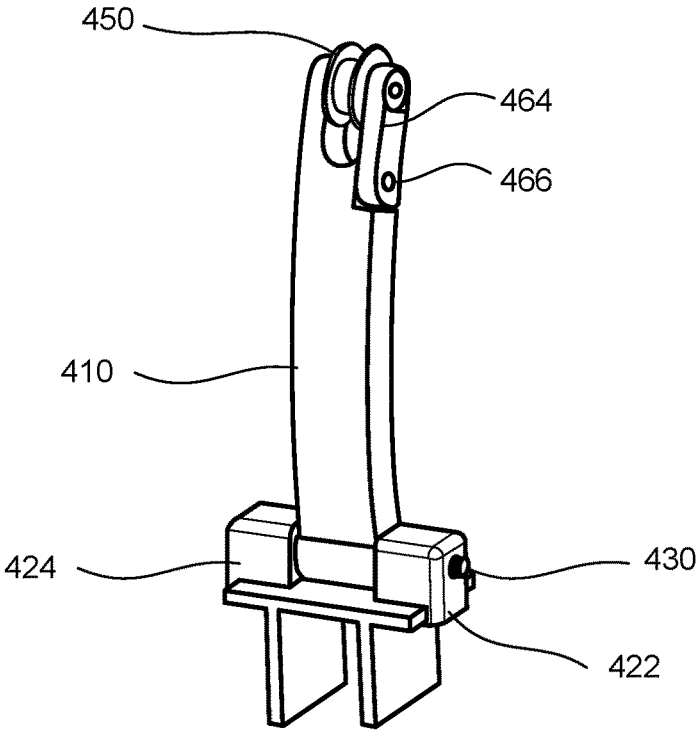

FIGS. 9A and 9B depict an alternative post and adaptive system according to aspects of the disclosure. In this example, an extended post 410 may be provided including a roller support 460. The post 410 may be curved, or otherwise shaped, e.g. to enhance its intended function when in use, and/or stowability when not in use.

As shown in FIG. 9B, the post 410 also has a cutout and mounting portion for connecting a gate 464 at hinge 466. In some examples, the gate 464 may include a recess or other engagement means that allow the gate 464 to mate with the roller support 460 and/or external portion of roller 450. As with the embodiment shown in FIGS. 1 and 2, the arm 410 may be mounted to a rail or other exercise machine component via connectors 424 and 422, via an interconnector 430 that goes through the hinge 412 and the connectors.

Figure 10:
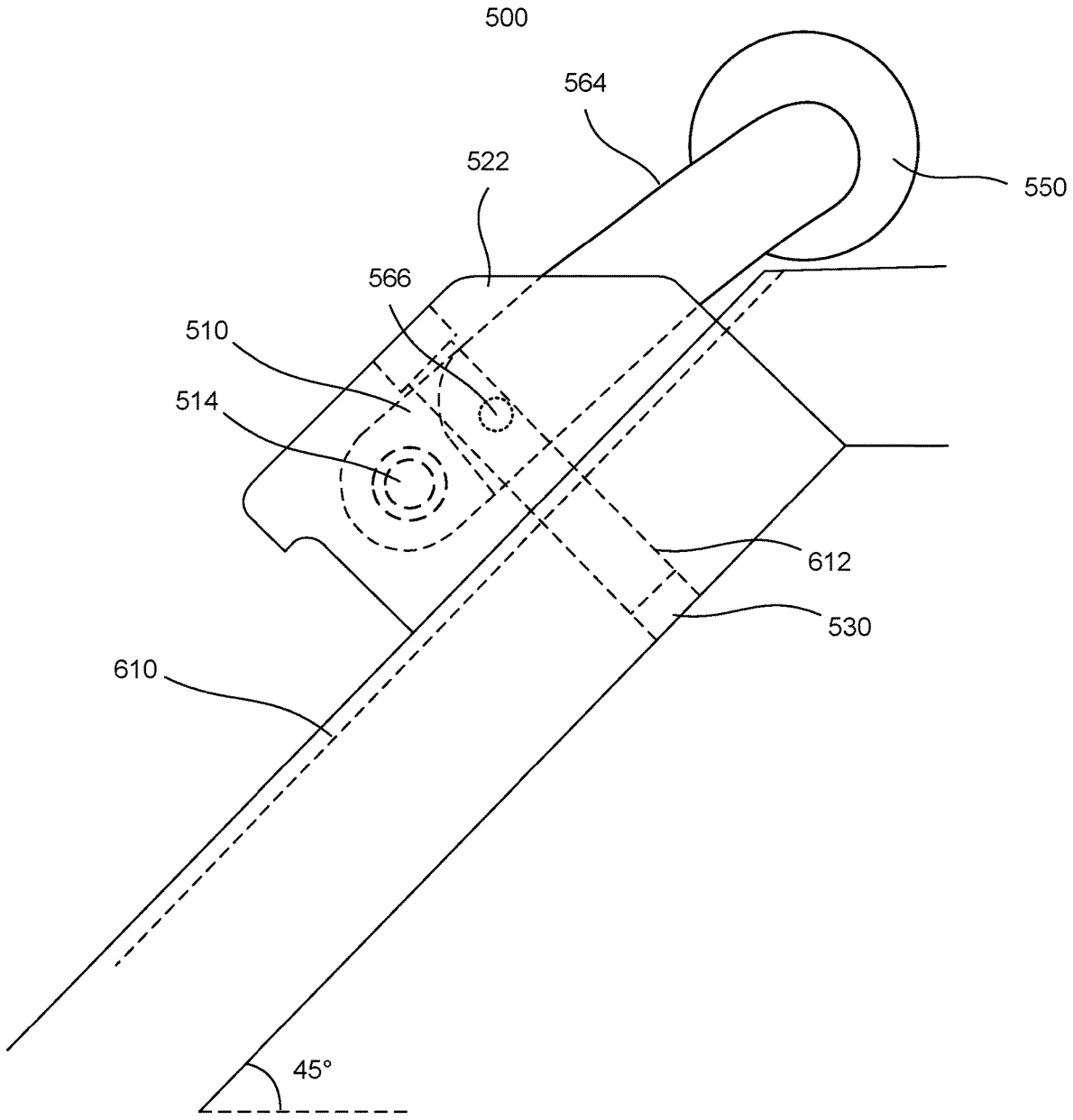
FIG. 10 depicts another exemplary adaptive system according to aspects of the disclosure.
Figure 11:
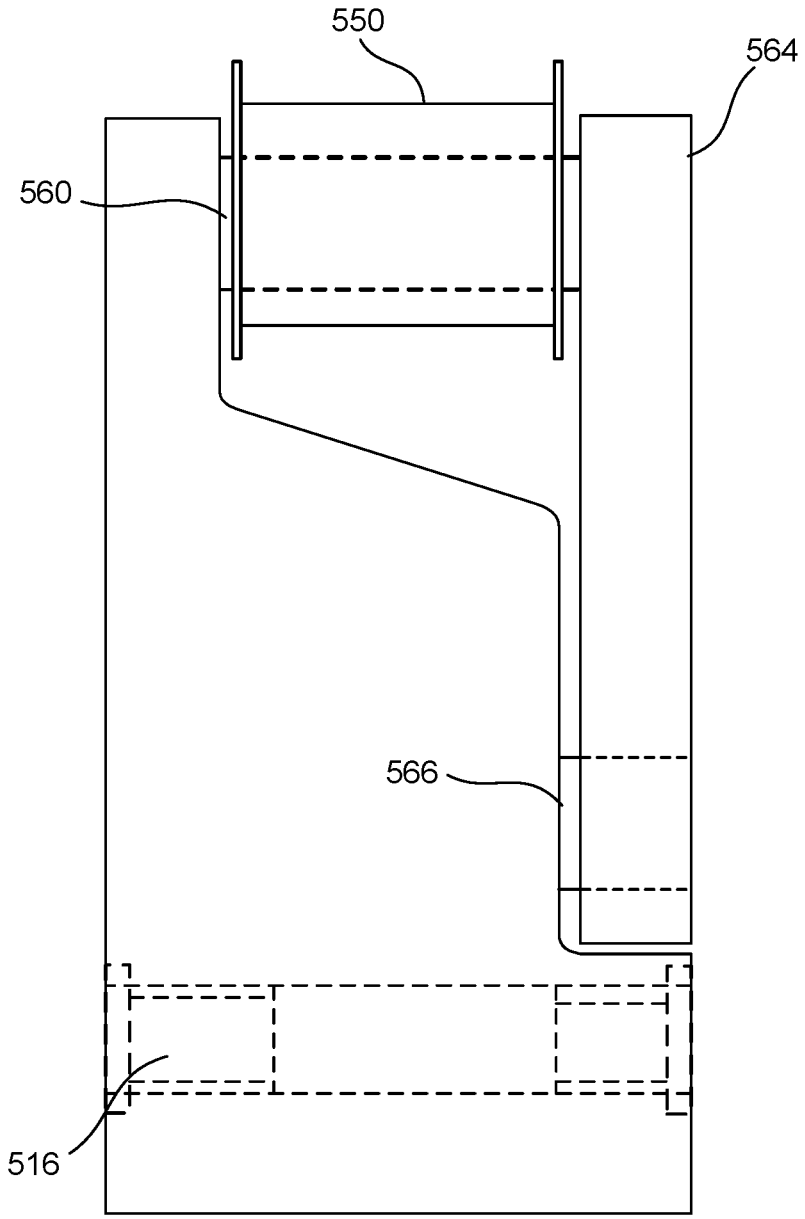
FIG. 11 depicts additional aspects of the exemplary adaptive system shown in FIG. 10.
Figure 12:
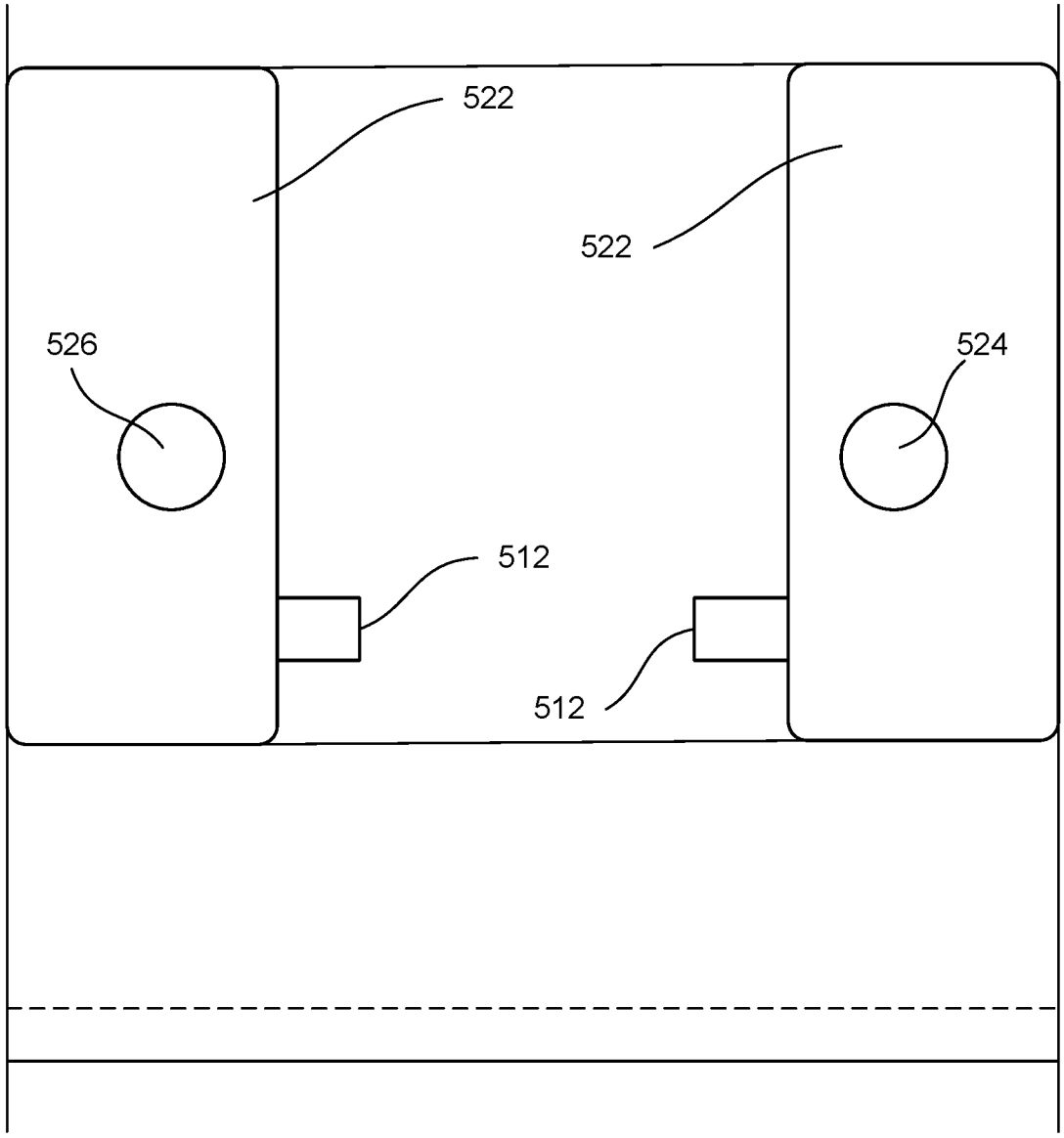
FIG. 12 depicts additional aspects of the exemplary adaptive system shown in FIG. 10.

FIGS. 10-12 depict another exemplary adaptive system according to aspects of the disclosure. In this example, pulley arm assembly 500 is configured to mount to an existing mounting point on a piece of exercise equipment, e.g. threaded or unthreaded holes intended to mount some other piece of equipment or component of the exercise machine. This may include, for example, mounting holes used to secure a rowing machine handle holder or cradle.

As shown in FIGS. 10-12, a mounting block(s) 522 may be configured to attach to preconfigured mounting holes 612, e.g. to attach the assembly 500 to a rowing machine through the existing handle rest mounting screws. As shown in FIG. 12, mounting blocks 522 may each include through-holes 524, 526, that allow the blocks 522 to be secured to preconfigured attachment points. In some examples, screws/bolts 530 may also fasten a footboard 610 to the frame of the exercise equipment. The mounting block(s) 522 may also be configured to host the pivoting pulley arm 510. This configuration would allow attachment of the block(s) 522 from top down and into the footboard mounting locations 612.

In this example, instead of a thru-axle pivot, the arm 510 may be allowed to rotate around pivot point 514 via machined bosses 512 protruding from the mounting block(s) 522 and received by annular recesses 516. However, a thru-axle pivot, as previously described, may also be used.

As shown in FIG. 11, roller 550 may be attached to the arm 510 via roller support 560. Assembly 500 also includes an elongated gate 564 that can pivot about hinge 566, similar to the configuration shown in FIGS. 9A and 9B. Thus, the gate 564 may be operated to allow access to the track between the roller 550 and the arm 510. The gate 564 may be biased to the closed position, e.g. via a spring in hinge 566.

Figure 13:
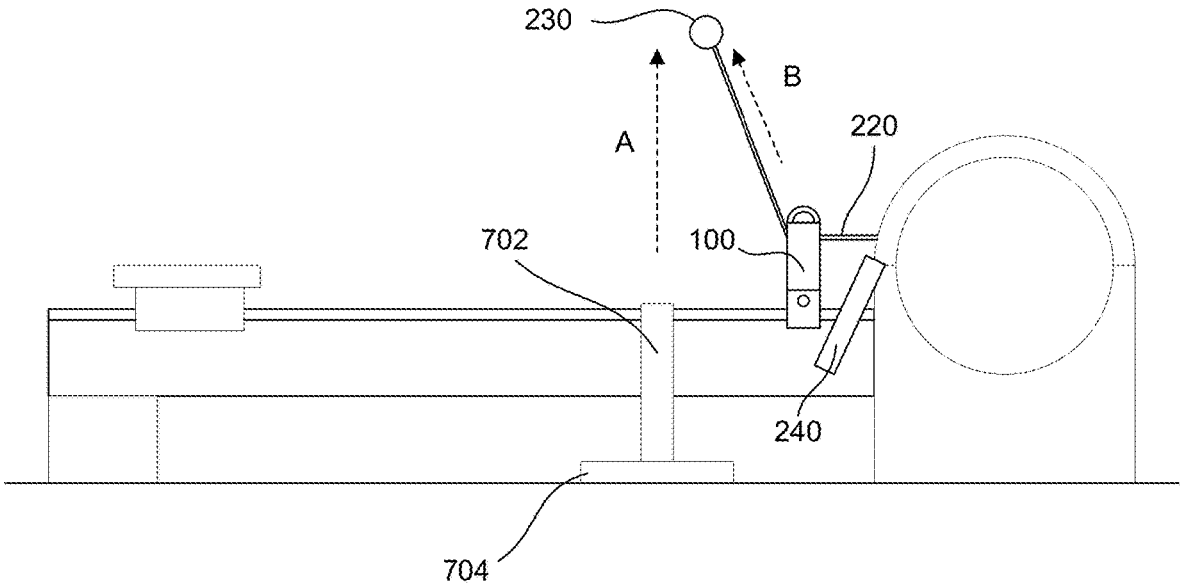
FIG. 13 depicts another exemplary adaptive system including a stabilizing platform according to aspects of the disclosure.

FIG. 13 depicts another exemplary adaptive system including a stabilizing platform according to aspects of the disclosure. In this example (and the example shown in FIG. 14), the inventor has addressed a problem specific to uses of the alternate exercise adapter attachments in which forces are applied to exercise equipment in direction(s) that the equipment is not designed to counteract. For example, when pulling chain 220/handle 230 in upward direction B, upward forces A may be transferred to the rail of a rowing machine, which can cause the entire rail to lift upward. As shown in FIG. 13, exemplary alternate exercise adapter assemblies may include a strap portion 702 configured to wrap, drape, or be attached to a rail of an exercise machine, and/or a platform 704 that is configured for a user to stand on and to secure the strap portion 702.

The standing platform/bracing strap provides a means to brace the machine against vertical application of force by utilizing the individual's body weight should the individual wish to stand to perform alternate exercises. The standing platform/bracing strap may mount to the machine proximate to the pulley arm assembly 100 and provide a standing platform effectively utilizing the individual's body weight as an opposing force, thus pinning the machine to the floor when vertical force is applied and preventing the rowing machine from lifting towards the user.

In some examples, a strap portion 702 may be used without a platform 704. However, the addition of platform 704, including secure attachment to strap portion 702, may advantageously prevent slippage of the strap portion 702, e.g. compared to the user standing on the strap alone.

In operation, the user will mount the pulley arm assembly 100 to the rowing machine as close to the foot pads 240 as is practical. The standing platform/bracing strap mounts immediately aft of the pulley arm assembly 100. Once mounted, the user manually guides the drive chain (or drive belt depending on manufacturer) into the open-block pulley. With the drive chain in the pulley, force may now be applied vertically. If standing, the user will straddle the machine, stand on the standing platform/bracing strap, and begin the desired exercise. If a seated exercise is desired, the user sits on the rowing machine's seat and begins to exercise.

Figure 14:
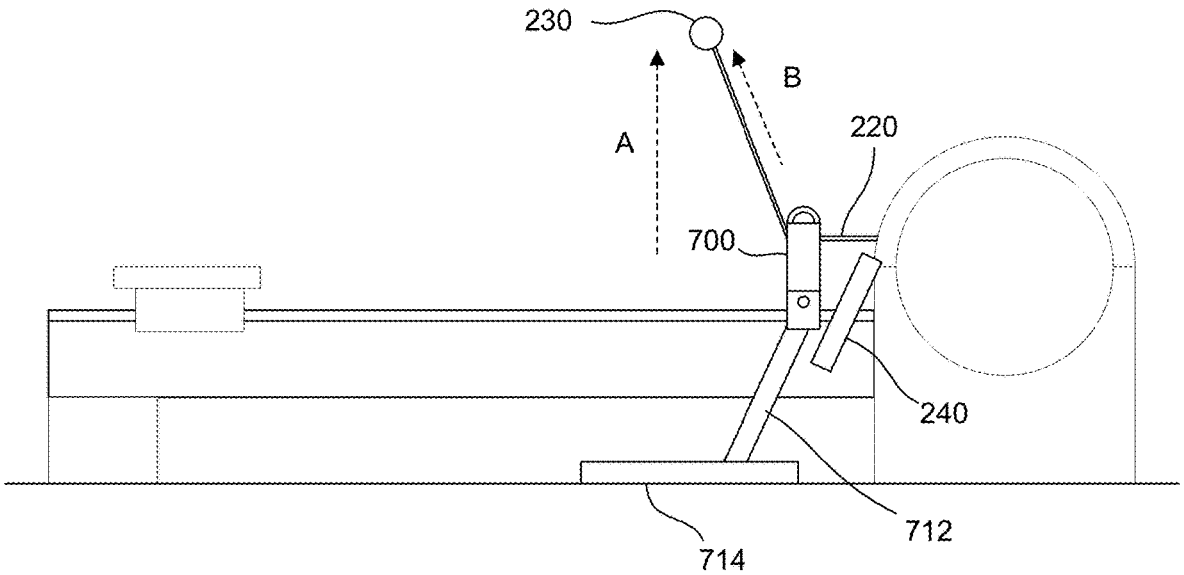
FIG. 14 depicts another exemplary adaptive system including a stabilizing platform according to aspects of the disclosure.

FIG. 14 depicts another exemplary adaptive system including a stabilizing platform according to aspects of the disclosure. In this case, the strap portion 712 may be secured to, or made integral with, the pulley arm assembly 100. Strap portion 712 may also be secured to platform 714, as discussed above.

Figure 15:
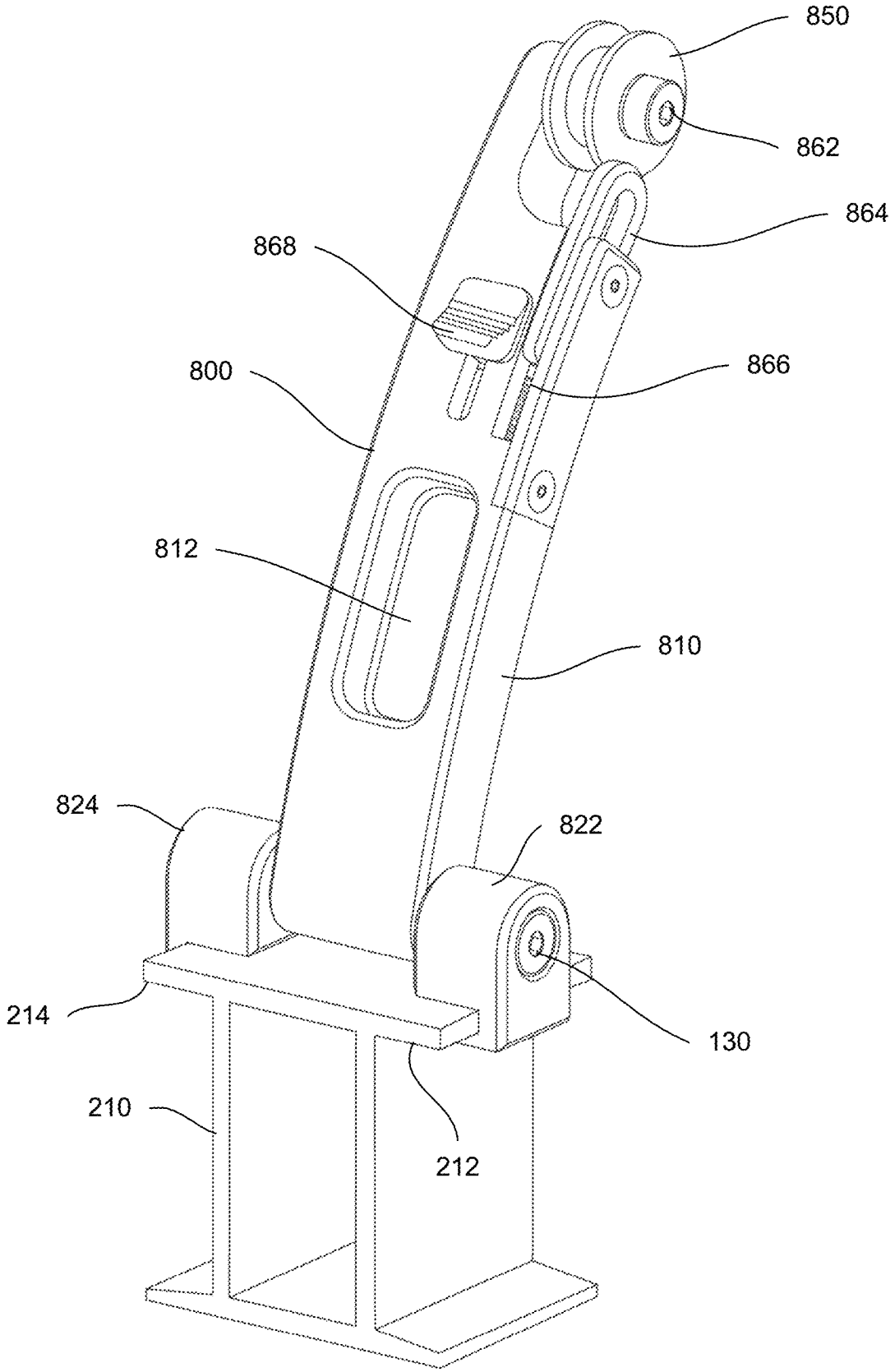
FIG. 15 depicts another exemplary adaptive system including a tracked gate according to aspects of the disclosure.

FIG. 15 depicts another exemplary adaptive system including a tracked gate according to aspects of the disclosure. As shown in FIG. 15, pulley arm assembly 800 may include a post 810, mounting blocks (shown as first rail grabber 822, and second rail grabber 824), interconnector 130, roller 850, and roller post/connector 862. The post 810 may be a machined metal (e.g. aluminum), or other material, and allow for voids, such as void 812, to reduce the overall weight of the assembly 800.

The mounting blocks (first rail grabber 822 and second rail grabber 824) may be configured to affix the post 810 of the pulley arm assembly to a rail or track-based exercise machine, such as a rowing machine. For example, similar to the configuration shown in FIGS. 1 and 2, an exercise machine rail may include beam 210, with a first flange 212, and a second flange 214.

The post 810 may be positioned between first rail grabber 822 and second rail grabber 824, and connected in a pivoting arrangement via an interconnector 130 that goes through post 810, first rail grabber 822, and second rail grabber 824. In use, the pulley arm assembly 800 can be positioned such that the pulling component of an exercise machine can be run partially around the roller 850.

Accordingly, in this embodiment, the mounting block(s) and pulley arm assembly facilitate the post 810 pivoting along the transverse axis via a single through-axle mechanism. The pulley arm assembly 800 can easily be installed and removed, and requires no modification to the rowing machine. Thus, a user can alter the normal resistance direction of the chain 220, e.g. from horizontally to vertically (or partially vertically), allowing the rowing machine (or other exercise equipment) to perform additional functions, such as curls, lifts, etc. As discussed previously, the pulley arm assembly 800 can also remain on the exercise machine when not in use without impeding the normal operation/function of the machine. For example, the post 810 can be rotated by the user (or allowed to fall via gravity or an internal spring bias) to a position in which the roller 850 does not interfere with the horizontal draw of the chain or other pulling component.

In this example, a sliding gate 864 may also be provided that opens and closes the track formed by the roller 850 and cutout of the post 810. The sliding gate 864 may include a track 866 and actuator 868 that allows it to transition between a closed position (as in FIG. 15) and an open position (with the gate 864 drawn downward). In some examples, the actuator 868 may include a spring that biases the gate 864 toward the closed position. A spring-actuated safety gate may be advantageous in that it allows for rapid insertion and removal of the pulling component, and prevents the pulling component from inadvertently disengaging from the track.

Figure 16:
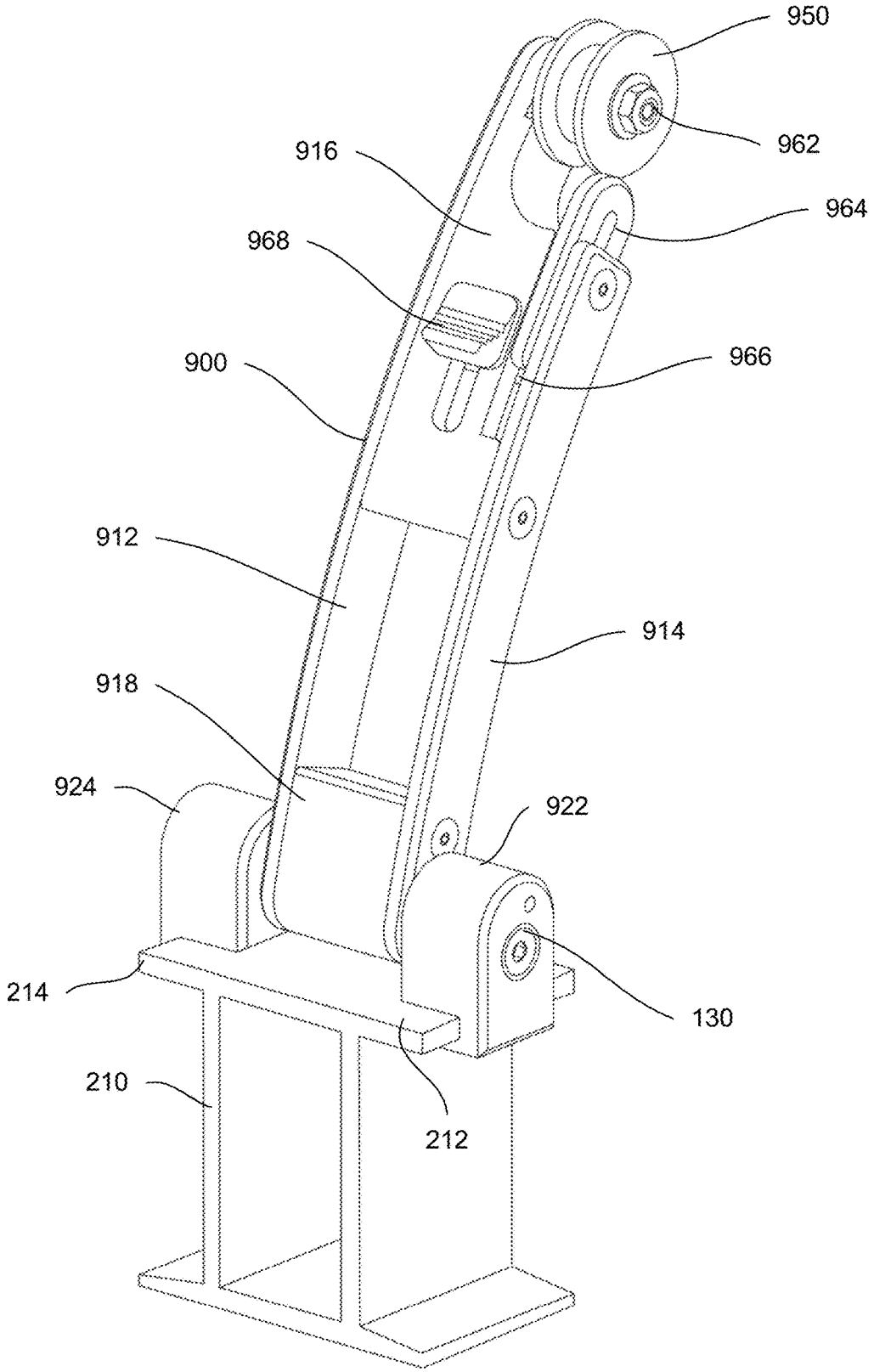
FIG. 16 depicts another exemplary adaptive system including a tracked gate according to aspects of the disclosure.

FIG. 16 depicts another exemplary adaptive system including a tracked gate according to aspects of the disclosure. As shown in FIG. 16, pulley arm assembly 900 may include post elements 912, 914, post blocks 916, 918, mounting blocks (shown as first rail grabber 922, and second rail grabber 924), interconnector 130, roller 950, and roller post/connector 962. The post elements 912, 914 may be used to reduce weight, e.g. compared to a monolithic post. Post blocks 916, 918 may be a machined metal (e.g. aluminum), or other material.

As with other embodiments previously described, the mounting blocks (first rail grabber 922 and second rail grabber 924) may be configured to affix the post assembly of the pulley arm 900 to a rail or track-based exercise machine, such as a rowing machine. For example, similar to the configuration shown in FIGS. 1 and 2, an exercise machine rail may include beam 210, with a first flange 212, and a second flange 214.

The post assembly (912, 914, 916, 918) may be positioned between first rail grabber 922 and second rail grabber 924, and connected in a pivoting arrangement via an interconnector 130 that goes through post assembly, first rail grabber 922, and second rail grabber 924. In use, the pulley arm assembly 900 can be positioned such that the pulling component of an exercise machine can be run partially around the roller 950.

Accordingly, in this embodiment, the mounting block(s) and pulley arm assembly facilitate the post assembly pivoting along the transverse axis via a single through-axle mechanism. The pulley arm assembly can easily be installed and removed, and requires no modification to the rowing machine. Thus, a user can alter the normal resistance direction of the chain 220, e.g. from horizontally to vertically (or partially vertically), allowing the rowing machine (or other exercise equipment) to perform additional functions, such as curls, lifts, etc. As discussed previously, the pulley arm assembly can also remain on the exercise machine when not in use without impeding the normal operation/function of the machine. For example, the post assembly can be rotated by the user (or allowed to fall via gravity or an internal spring bias) to a position in which the roller 950 does not interfere with the horizontal draw of the chain or other pulling component.

In this example, a sliding gate 964 may also be provided that opens and closes the track formed by the roller 950 and cutout of the post block 916. The sliding gate 964 may include a track 966 and actuator 968 that allows it to transition between a closed position (as in FIG. 16) and an open position (with the gate 964 drawn downward). In some examples, the actuator 968 may include a spring that biases the gate 964 toward the closed position. A spring-actuated safety gate may be advantageous in that it allows for rapid insertion and removal of the pulling component, and prevents the pulling component from inadvertently disengaging from the track.

Although many of the connections described herein have used threaded coupling, embodiments may include any form of joining that are known in the art. For example, parts may be joined together using clamps, cams, teeth and slots, compression fittings, etc.

Any feature of any embodiment discussed herein may be combined with any feature of any other embodiment discussed herein in some examples of implementation, unless otherwise specified.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

While the foregoing is directed to embodiments of the present invention, other and further embodiments of the invention may be devised without departing from the basic scope thereof, and the scope thereof is determined by the claims that follow.

What is claimed is:

1. An adaptive system for use with an exercise machine having an intended function, the system comprising:

a post having a proximal end and a distal end;

a roller disposed at the distal end of the post;

an attachment mechanism configured to attach the proximal end of the post to the exercise machine, wherein, the post includes a track configured to accommodate at least one of a chain, cable, line, or strap of the exercise machine between an edge of the roller and an edge of the track, wherein, the track is accessible by a user to insert and remove the at least one of a chain, cable, line, or strap to or from the track, and wherein, the post is configured to transition between a first position when the system is in use and a second position when the system is not in use, such that (a) when the system is not in use, the at least one of a chain, cable, line, or strap of the exercise machine can operate according to the intended function without obstruction by the system, and (b) when the system is in use, the at least one of a chain, cable, line, or strap of the exercise machine operate through the system to provide another exercise function that is different than the intended function.

2. The adaptive system of claim 1, wherein the attachment mechanism is configured to attach the proximal end of the post to a rail of the exercise machine or a preconfigured attachment point intended for another part of the exercise machine.

3. The adaptive system of claim 1, further comprising a gate that is configured to selectively open and close the track to:

allow the user to insert the at least one of a chain, cable, line, or strap in the track and remove the at least one of a cable, line, or strap from the track with the gate open, and retain the at least one of a chain, cable, line, or strap in the track with the gate closed.

4. The adaptive system of claim 1, wherein the system is configured to attach to a rowing machine.

5. The adaptive system of claim 1, wherein the first position substantially horizontally aligns the roller with a path of the at least one of a chain, cable, line, or strap, and allows the at least one of a cable, line, or strap to be drawn upward by the user for resistance training.

6. The adaptive system of claim 1, wherein the first position substantially horizontally aligns the roller with a path of the at least one of a chain, cable, line, or strap, and the second position removes the roller from horizontal alignment with the at least one of a chain, cable, line, or strap.

7. The adaptive system of claim 1, wherein the post is configured to transition between the first position and the second position via at least one of gravity or user manipulation.

8. The adaptive system of claim 1, wherein the post is mechanically biased toward the second position.

9. The adaptive system of claim 1, further comprising a platform configured to allow the user to stand upon it while using the system, and including a platform securing mechanism configured to attach the platform to the rail of the exercise machine and to thereby resist upward movement of the rail during use of the system with the exercise machine.

10. The adaptive system of claim 1, further comprising a securing band configured to allow the user to stand upon it, and to attach to the rail of the exercise machine, while using the system, and to thereby resist upward movement of the rail during use of the system with the exercise machine.

11. The adaptive system of claim 1, wherein the attachment mechanism includes a first rail connector, a second rail connector, and a connector that is configured to attach the first rail connector to the second rail connector on opposite sides of the rail of the exercise machine, and wherein the connector is configured to pass through a portion of the proximal end of the post.

12. An adaptive system for use with an exercise machine, the system comprising:

a post including a proximal end, a distal end, a roller disposed at the distal end of the post, and a track configured to accommodate at least one of a cable, line, or strap of the exercise machine between an edge of the roller and an edge of the track, wherein, the track is accessible by a user to insert and remove the at least one of a chain, cable, line, or strap of the exercise machine to or from the track;

an attachment mechanism configured to attach the proximal end of the post to the exercise machine; and a gate configured to selectively open and close the track to:

allow the user to insert the at least one of a chain, cable, line, or strap in the track and remove the at least one of a chain, cable, line, or strap from the track with the gate open, and retain the at least one of a chain, cable, line, or strap in the track with the gate closed.

13. The adaptive system of claim 12, wherein, the post is configured to transition between a first position when the system is in use and a second position when the system is not in use.

14. The adaptive system of claim 13, wherein the first position substantially horizontally aligns the roller with a path of the at least one of a chain, cable, line, or strap, and allows the at least one of a chain, cable, line, or strap to be drawn upward by the user for resistance training.

15. The adaptive system of claim 13, wherein the first position substantially horizontally aligns the roller with a path of the at least one of a chain, cable, line, or strap, and the second position removes the roller from horizontal alignment with the at least one of a chain, cable, line, or strap.

16. An adaptive system for use with a rowing machine, the system comprising:

a post having a proximal end, a distal end, and a track configured to accommodate at least one of a chain, cable, line, or strap of the rowing machine, wherein the track is accessible by a user to insert and remove the at least one of a chain, cable, line, or strap to or from the track;

an attachment mechanism configured to attach the proximal end of the post to the rowing machine, and a gate that is configured to selectively open and close the track to:

allow the user to insert the at least one of a chain, cable, line, or strap in the track and remove the at least one of a chain, cable, line, or strap from the track with the gate open, and retain the at least one of a chain, cable, line, or strap in the track with the gate closed, wherein, the post is configured to transition between a first position when the system is in use and a second position when the system is not in use.

17. The adaptive system of claim 16, wherein the attachment mechanism includes a first rail connector, a second rail connector, and a connector that is configured to attach the first rail connector to the second rail connector on opposite sides of a rail of the rowing machine, and wherein the connector is configured to pass through a portion of the proximal end of the post.

* * * * *